US005643016A

United States Patent [19]

Huss, Jr.

[11] Patent Number: 5,643,016

[45] Date of Patent: Jul. 1, 1997

[54] ELECTRICAL CONNECTOR ASSEMBLY WITH CONTACT RETENTION AND REMOVAL SYSTEM

[75] Inventor: John Phillip Huss, Jr., Harrisburg, Pa.

[73] Assignee: The Whitaker Corporation, Wilmington, Del.

[21] Appl. No.: 506,994

[22] Filed: Jul. 28, 1995

[51] Int. Cl.[6] ..... H01R 13/426

[52] U.S. Cl. ..... 439/744; 439/689

[58] Field of Search ..... 439/744, 689

[56] References Cited

U.S. PATENT DOCUMENTS

| | | | |
|---|---|---|---|
| 3,475,720 | 10/1969 | Culver | 439/744 |
| 3,808,590 | 4/1974 | Hemmer et al. | 339/217 S |
| 4,010,993 | 3/1977 | Hohenberger et al. | 339/31 R |
| 4,421,378 | 12/1983 | Sanford et al. | 339/217 R |
| 4,580,341 | 4/1986 | Chapelot | 29/874 |
| 4,701,004 | 10/1987 | Yohn | 439/871 |
| 4,776,816 | 10/1988 | Herscovici et al. | 439/744 |

FOREIGN PATENT DOCUMENTS

| | | | |
|---|---|---|---|
| 1480342 | 5/1967 | France | 439/744 |
| 3413115 | 10/1985 | Germany | 439/744 |
| 877666 | 10/1981 | U.S.S.R. | 439/744 |

*Primary Examiner*—Gary F. Paumen
*Attorney, Agent, or Firm*—Anton P. Ness

[57] ABSTRACT

The electrical connector assembly of the present invention generally comprises an insulating housing (100), a plurality of retention clips (200) disposed in electrical contact receiving cavities (106) within the housing (100), a plurality of electrical contacts (400), and a spacer-cap (300) that is adapted to provide lead-in for a mating connector. Cavities (106) define, within the insulating housing (100), (i) at least two opposing longitudinal slots (120) having opposing recesses (126) and (ii) at least one ledge (130) that protrudes into the cavity (106) above the recesses (126). Retention clip (200) comprises a plurality of cantilevered spring members (204, 206) that project downwardly from an annular portion (202). A first pair of spring members (204) are disposed in opposing outwardly protruding relation to one another. Each of the spring members (204) further includes an outwardly protruding latch (232) disposed at its free end (230). Each latch (232) is adapted to releasably engage a shoulder (128) defined within the cavity's (106) longitudinal slot (120), when the retention clip (200) is positioned within the insulating housing (100). A second pair of spring members (206) is disposed in opposing inwardly protruding relation to one another on the annular portion (202). Each of the spring members (206) in the second pair includes an inwardly protruding latch (240)disposed at its free end (236). The latches (240) are adapted to releasably engage a groove (406) disposed on electrical contact (400) when the retention clip (200) is positioned within the insulating housing (100) and the electrical contact (400) is disposed within the cavity (106).

13 Claims, 6 Drawing Sheets

ELECTRICAL CONNECTOR ASSEMBLY WITH CONTACT RETENTION AND REMOVAL SYSTEM

FIELD OF THE INVENTION

This invention relates to electrical connector assemblies in general, and more particularly to the retention of electrical contacts within an electrical connector assembly.

BACKGROUND OF THE INVENTION

Electrical connector assemblies having contact retention schemes are well known in the art. For example, U.S. Pat. No. 3,808,590, issued to Hemmer et al., discloses an electrical connector having a built-in tool that is adapted for removing electrical contacts from the connector during maintenance and/or repair. Hemmer teaches a moveable bushing that is mounted on each of the contacts of the connector. The moveable bushing is adapted to release the contact from a contact retention insert disposed within the connector housing. The contact retention insert comprises at least two downwardly and inwardly projecting cantilevered beams that are adapted to engage a shoulder portion of the contact. Each contact includes an annular groove disposed above the shoulder portion, that provides more secure retention of the contact within the insert. The built-in tool includes one or more outwardly extending fingers that prevent inadvertent movement of the tool to a position that would release the contact from its secured position within the insert.

In another example, U.S. Pat. No. 4,010,993, issued to Hohenberger et al., discloses an electrical connector assembly comprising an insulating housing having a passageway extending therethrough. The passageway is adapted to hold a one-piece sleeve of electrically conductive material that is adapted to provide both mechanical and electrical interconnection to a mating contact. The one-piece sleeve comprises a resilient latching member that extends outwardly toward an interior wall of the passageway so as to lock the sleeve in place within the housing. The sleeve also includes a contact on its inner surface that is adapted to provide electrical interconnection for a mating connector member. Hohenberger teaches the use of the same insulating housing for both male and female contacts. The sleeve of Hohenberger may also be provided with a soldering extension so that the sleeve may be soldered to a conductor on an electrical circuit.

In a further example, U.S. Pat. No. 4,421,378, issued to Sanford et al., discloses an electrical connector insert and retention clip combination. Sanford teaches an integrally molded connector housing formed from dielectric material and comprising a plurality of passages that extend from a rear face to a front face. A retention clip shoulder housing is disposed near the rear face of each passage. Each retention clip shoulder housing includes a rearwardly facing sleeve abutment which is adapted to reduce the bore of the passage. The retention clip shoulder housing and sleeve abutment form the rear and front boundaries of a retention clip cavity. The retention clip shoulder housing allows the close passing and securing of a contact retention clip therein. The contact retention clip consists of at least two fingers which, when mounted within the passage, are positioned forwardly and radially inward to form a resilient cone. In operation, an electrical connector pin, having an elongated body and including an enlarged section, is inserted into the passage. As the connector pin enters the retention clip, it causes the retention clip fingers to be forced away from their rest position, and against the walls of the passage. Once the enlarged section of the contact clears the fingers, the fingers return to their rest position against the rear wall of the enlarged section. In this way, the connector pin is removably secured within the passage.

In yet another example, U.S. Pat. No. 4,701,004, issued to Yohn, discloses a retention clip for use in a one-piece housing. The retention clip includes a plurality of spaced pairs of locking lances located around its circumference and proximate to its middle. The spaced pairs of locking lances are adapted to engage an annulus disposed along a housing passageway. The locking lances extend forwardly from a rear end of the clip and radially inwardly so as to engage a rear stop surface of an electrical terminal that is inserted into the clip. The lances are deflectable outwardly by the electrical terminal during insertion of the terminal into the passageway. The lances are also deflectable outwardly by a removal tool that may be inserted along the terminal, between the terminal and the clip, to permit same face terminal removal. Short, radially inwardly disposed tabs at the front end of the clip provide forward stops that engage a forward stop surface of the electrical terminal. Yohn further discloses a socket contact section that may be modified to form opposing surface portions, adjacent to the rearward terminal stop surface, to permit latching by the clip's latching projections.

In yet a further example, U.S. Pat. No. 4,776,816, issued to Herscovici et al., discloses an electrical connector assembly consisting of a supporting housing, and a locking clip that is positioned within an open recess in the housing. The locking clip comprises an annular body having at least two inwardly projecting spring members and at least two inwardly protruding stop tabs. An electrical contact may be disposed cooperatively within the clip so as to be latched between the spring members and the stop tabs. The electrical contact consists of an oblong member having a ring rigidly mounted therearound. The contact is disposed within the locking clip so that the ring is disposed between the tips of the spring members and the stop tabs. The clip is sized and shaped so that the contact ring is pressed against the stopping elements by the spring members, thus preventing the contact from rattling about in the cavity and damaging the relatively soft housing.

SUMMARY OF THE INVENTION

The present invention provides a novel electrical connector assembly that is adapted to releasably retain a plurality of electrical contacts. The novel electrical connector assembly generally comprises an insulating housing, a plurality of retention clips, a plurality of electrical contacts, and a spacer-cap.

In a preferred embodiment, the insulating housing includes an upper surface, a lower surface, and a plurality of electrical contact receiving cavities extending therebetween. The cavities are defined within the insulating housing by a plurality of surrounding internal structures that comprise: (i) at least two opposing longitudinal slots having opposing recesses disposed therein in spaced-away relation to the upper and lower surfaces of the insulating housing, and (ii) at least one ledge that protrudes into the cavity above the recesses. The cavities are arranged within the insulating housing in a predetermined pattern.

The retention clips each comprise a plurality of cantilevered spring members that project downwardly from the walls defining an annular portion of the clip. More particularly, a first pair of spring members are disposed in opposing outwardly protruding relation to one another on a first pair of opposing walls. Each of the spring members in the first pair further includes an outwardly protruding latch disposed at its free end. Each latch of the first pair of spring members is adapted to releasably engage a shoulder defined within the cavity's longitudinal slot, when the retention clip is positioned within the insulating housing. A second pair of spring members is disposed in opposing inwardly protruding relation to one another on a second pair of opposing walls of the annular portion. Each of the spring members in the second pair includes an inwardly protruding latch disposed at its free end. Each latch of the second pair of spring members is adapted to releasably engage a portion of the electrical contact.

The electric contacts each generally comprise an upper mating portion having an outer surface, a lower mating portion, and a circumferential groove disposed therebetween. The groove is adapted to releasably engage each of the second pair of spring members' latches, when the electrical contact is positioned within the cavity.

The spacer-cap is releasably attached to the upper surface of the insulating housing after the contacts are positioned within the retention clips, and comprises a plate having an upper surface, a lower surface, and a plurality of bores extending therebetween. The bores are disposed within the plate in a pattern corresponding to the predetermined pattern of cavities in the insulating housing. The spacer-cap further includes a plurality of cantilevered beams that project downwardly from the lower surface, in surrounding relation to the bores. The beams are shaped and oriented so as to engage the outer surface of the upper mating portion of the electrical contacts so as to provide stable positioning thereof within the cavity.

A novel system is provided comprising an electrical contact assembly tool and the electrical connector assembly of the present invention.

A novel method is also provided for engaging and disengaging each electrical contact within the insulating housing of the electrical connector assembly of the present invention.

BRIEF DESCRIPTION OF THE DRAWINGS

The preferred embodiment of the invention will now be described, by way of example, with reference being made to the accompanying drawings wherein like numerals refer to like parts and further wherein.

DETAILED DESCRIPTION OF THE PREFERRED EMBODIMENT

Figure 1:
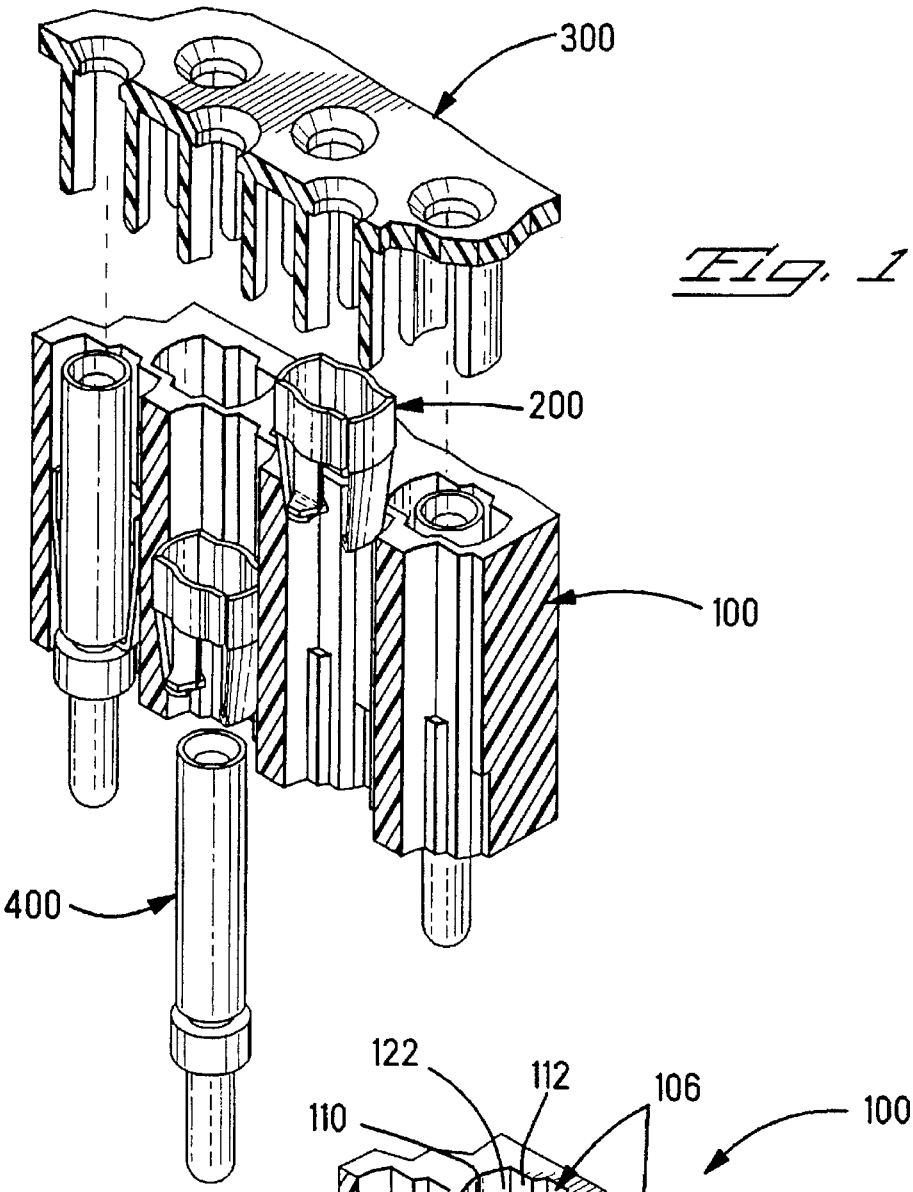
FIG. 1 is a broken-away cross-sectional view of the electrical connector assembly and contact retention system of the present invention, with the constituent elements of the present invention shown in an exploded perspective view.

Referring first to FIG. 1, a preferred embodiment of the electrical connector assembly of the present invention comprises an insulating housing 100, a plurality of retention clips 200, a spacer-cap 300, and a plurality of electrical contacts 400. It will be appreciated that insulating housing 100 may have any of the shapes typically used for printed circuit board mount electrical connectors, e.g., rectangular, circular, trapezoidal, oval, etc. Likewise, electrical contact 400 may comprise either male or female, or a combination of male and female terminals, of the type typically employed in printed circuit board mount electrical connectors. Thus, the present invention will hereinafter be disclosed with reference to those essential features of insulating housing 100 and electrical contacts 400 that are necessary for practicing the present invention.

Figure 2:
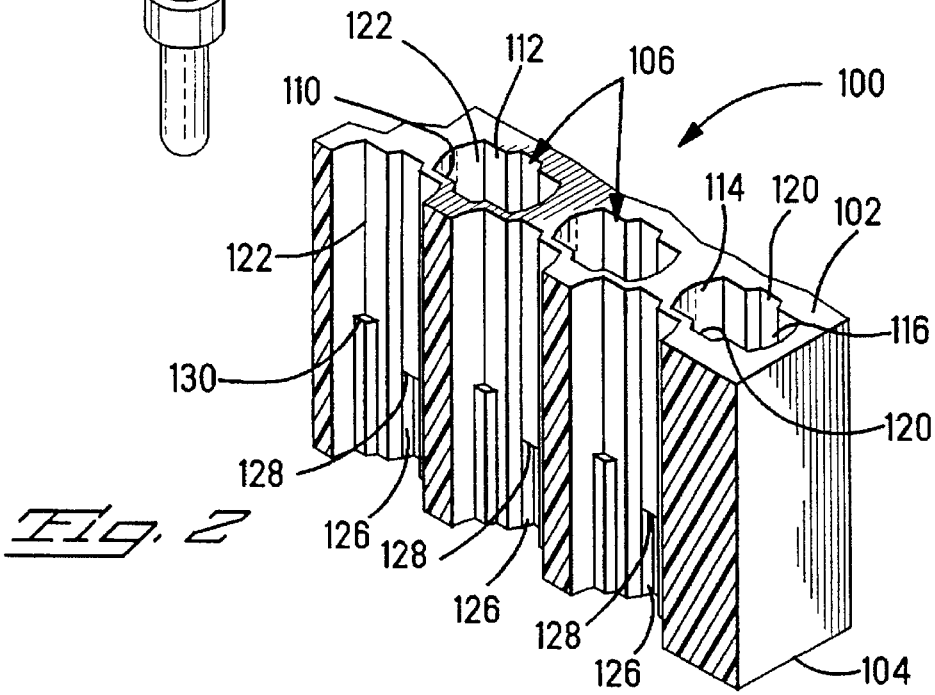
FIG. 2 is a broken-away cross-sectional view, in perspective, of a portion of the insulating housing.

More particularly, and now referring to FIG. 2, insulating housing 100 comprises an upper surface 102, a lower surface 104, and a plurality of cavities 106. Insulating housing 100 may be formed from any one of the various plastic materials commonly used in the electrical connector arts. In one preferred embodiment of the present invention, a liquid crystal polyester such as the one manufactured by Amoco Performance Products Inc., under the tradename Xydar®, is used with satisfactory results. Typically, upper surface 102 and lower surface 104 are disposed in substantially parallel, spaced-apart relation to one another. Lower surface 104 may also include one or more hold down devices (not shown) that are adapted to maintain insulating housing 100 in position on a printed circuit board surface.

Insulating housing 100 includes a plurality of cavities 106. As used herein, the term "cavity" is meant to refer to an open void extending through insulative housing 100. It will be appreciated by those skilled in the electrical connector arts however, that the term "cavity" also refers to the surrounding internal structures that define the shape of the void. Thus, with the present invention, each cavity is defined by a front wall 110, a rear wall 112, side walls 114 and 116, and two longitudinal slots 120.

More particularly, each cavity 106 extends between, and opens onto, upper surface 102 and lower surface 104. In a preferred embodiment, front wall 110, rear wall 112, and side walls 114 and 116 define a substantially rectangular void. A corner 122 is formed where each wall intersects with its neighboring walls. Longitudinal slots 120 extend along the length of front wall 110 and rear wall 112. Each slot 120 includes a recess 126 that defines a shoulder 128 within slot 120. Recesses 126 are disposed in spaced-away relation from both upper surface 102 and lower surface 104. Shoulder 128 extends into insulating housing 100, and is sized and shaped so as to be releasably engaged by a corresponding latch portion of retention clip 200, as will hereinafter be disclosed in further detail. A ledge 130 is located in each corner 122 of each cavity 106. Each ledge 130 is also disposed in spaced-away relation to upper surface 102 and lower surface 104. Ledges 130 protrude into each cavity, above shoulder 128, so as to position retention clip 200 at a predetermined location within cavity 106, as will hereinafter be disclosed in further detail.

Figure 3:
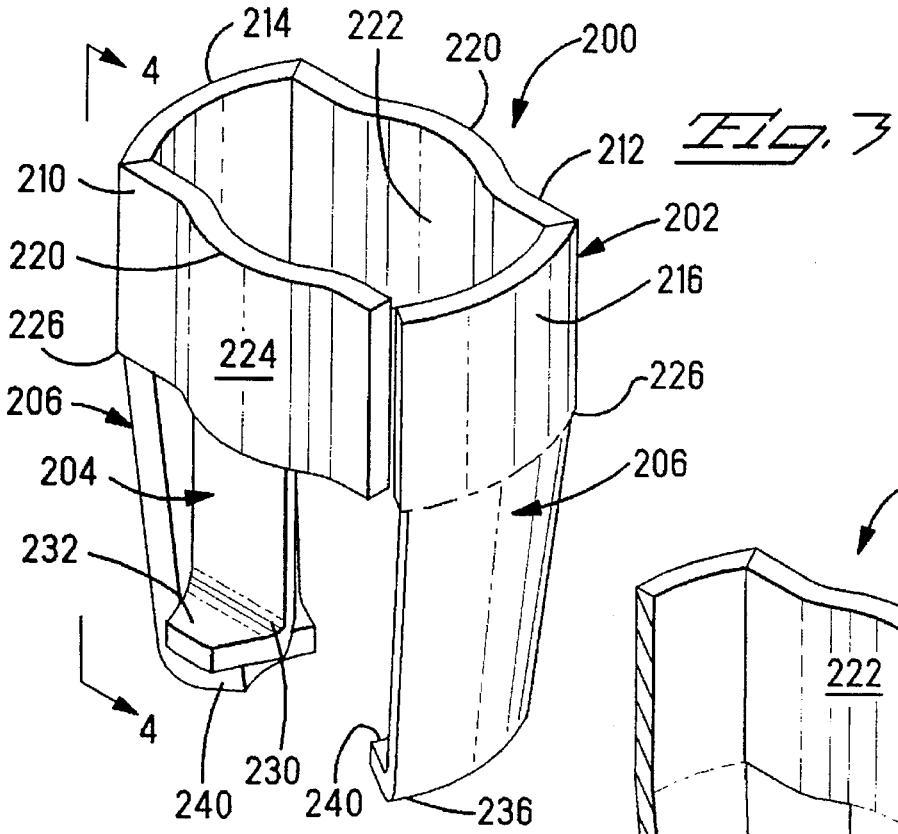
FIG. 3 is a perspective view of the retention clip.
Figure 4:
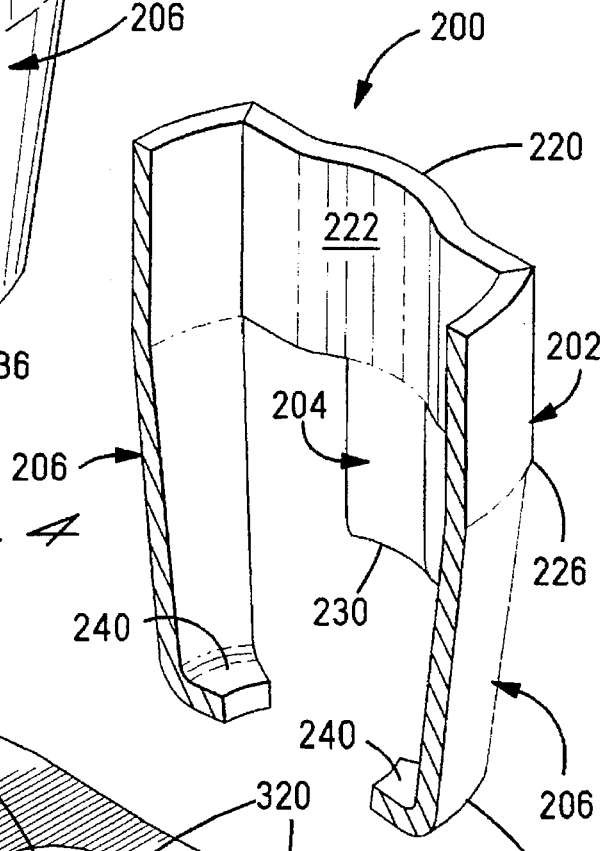
FIG. 4 is a cross-sectional view of the retention clip, as taken along line 4—4 in FIG. 3

Referring now to FIGS. 3 and 4, each retention clip 200 comprises an annular portion 202, a first pair of spring members 204, and a second pair of spring members 206. Retention clip 200 is typically stamped and formed from any one of the various spring metal alloys commonly used in the electrical connector arts, e.g., beryllium copper, stainless steel, heat treated brass, etc. In one preferred embodiment of the present invention, half-hard phosphor bronze, UNS No. C51000 is used with satisfactory results. It will be appreciated that retention clip 200 may also be formed from any one of the various resilient plastic materials commonly used in the electrical connector arts, and may or may not be formed from the same plastic material as insulating housing 100.

In a preferred embodiment, annular portion 202 generally corresponds in shape to cavities 106 of insulating housing 100. In particular, annular portion 202 is substantially rectangularly shaped, having a front wall 210, a rear wall 212, and side walls 214 and 216. However, front wall 210 and rear wall 212 of retention clip 200 each may include an outwardly protruding bulge 220 that is adapted to control an upper portion of electrical contact 400, as will hereinafter be disclosed in further detail. Annular portion 202 also comprises an inner surface 222, an outer surface 224, and lower corners 226. It will be understood that annular portion 202 may also comprise other shapes that correspond to the various electrical contact receiving cavity shapes that are well known in the art, e.g., circular, oval, square, polygonal, etc., without departing from the scope or spirit of the present invention.

Still referring to FIGS. 3 and 4, first pair of spring members 204 are cantilevered so as to project downwardly and outwardly, in opposing relation, from the bottom of annular portion 202. More particularly, one spring member 204 projects downwardly and outwardly from the bottom of front wall 210, and one spring member 204 projects downwardly and outwardly from the bottom of rear wall 212. Free end 230, of each spring member 204, comprises an outwardly protruding latch 232 that is sized and shaped so as to be releaseably engaged by shoulder 128 of cavity 106 when electrical contact 400 is assembled to insulating housing 100, as will hereinafter be disclosed in further detail.

Second pair of spring members 206 are cantilevered so as to project downwardly and inwardly, in opposing relation, from the bottom of annular portion 202. More particularly, one spring member 206 projects downwardly and inwardly from the bottom of side wall 214, and one spring member 206 projects downwardly and inwardly from the bottom of side wall 216. Free end 236, of each spring member 206, comprises an inwardly and upwardly protruding latch 240. Latch 240 projects upwardly so as to provide lead-in to facilitate the insertion of electrical contact 400 into insulating housing 100 during assembly, as will hereinafter be disclosed in further detail. Latches 240 are spaced-apart, in confronting relation, by a predetermined distance that is chosen so as to provide for releasable engagement of electrical contact 400.

Figure 5:
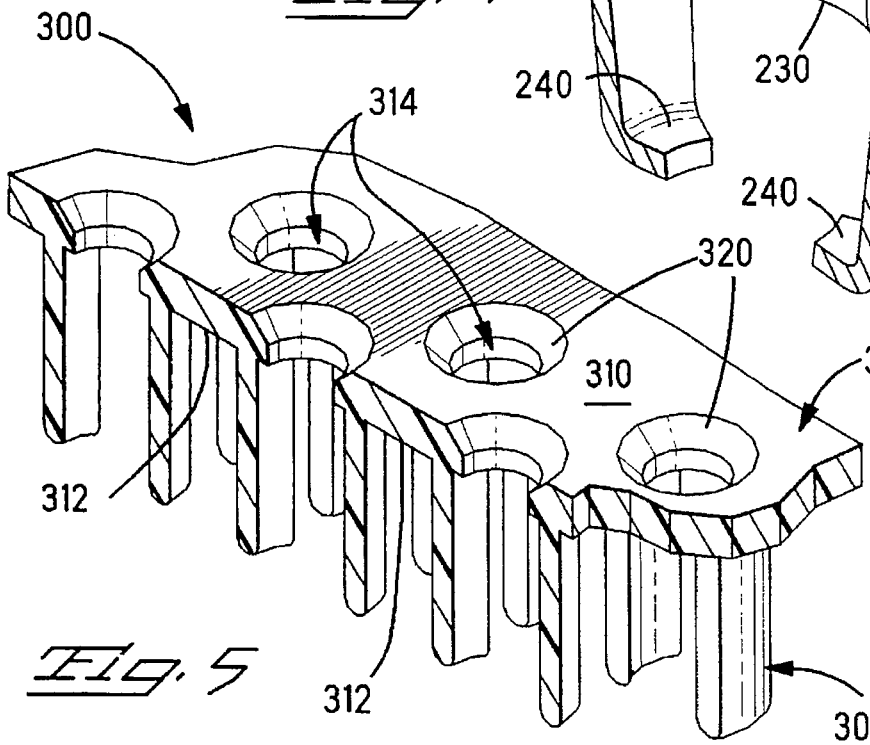
FIG. 5 is a perspective view of the spacer-cap.

Referring now to FIG. 5, spacer-cap 300 comprises a plate 302 and a plurality of sockets 304. Spacer-cap 300 may also be formed from any one of the various plastic materials commonly used in the electrical connector arts, and may or may not be formed from the same plastic material as insulating housing 100. In a preferred embodiment, plate 302 is sized and shaped to fit over, and entirely cover, upper surface 102 of insulating housing 100. Plate 302 comprises a connector mating surface 310, a housing mating surface 312, and a plurality of bores 314. Bores 314 are arranged within plate 302 so as to correspond to the pattern of cavities 106 in insulating housing 100. A chamfer 320 is disposed about each bore 314, on connector mating surface 310, so as to provide "lead-in" for guiding a mating contact into bore 314 during interconnection with a corresponding mating electrical connector assembly.

Sockets 304 each comprise a pair of opposing, segment-shaped cantilevered beams that are disposed on housing mating surface 312 in surrounding-relation to each bore 314. Sockets 304 project downwardly from housing mating surface 312 in spaced-apart relation so as to: (i) be received, one pair per cavity, in insulating housing 100, and (ii) accept an upper portion of electrical contact 400, after each electrical contact 400 is releasably engaged within a retention clip 200.

Figure 9:
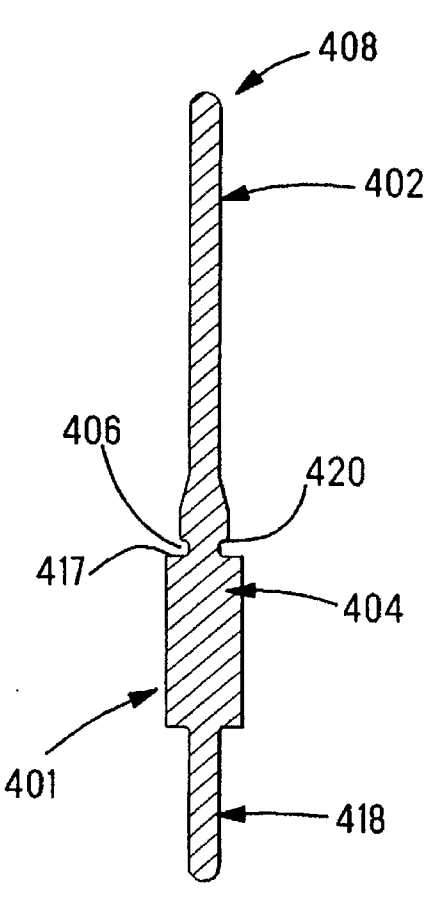
FIG. 9 is a cross-sectional view of the electrical contact shown in FIG. 8, as taken along line 9—9 in FIG. 8.
Figure 8:
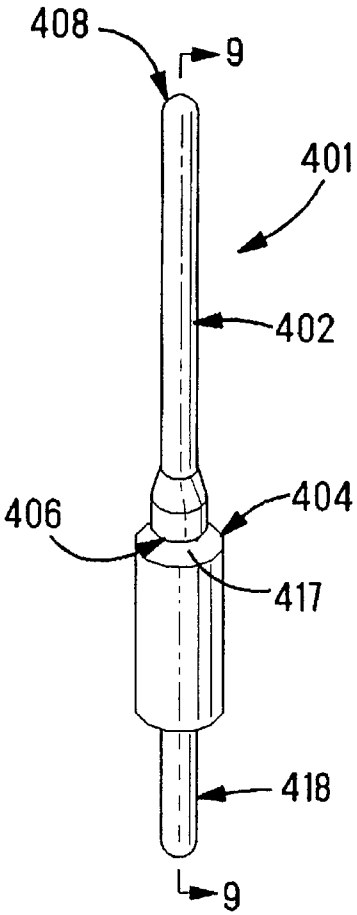
FIG. 8 shows another embodiment of an electrical contact adapted for use with the present invention.
Figure 7:
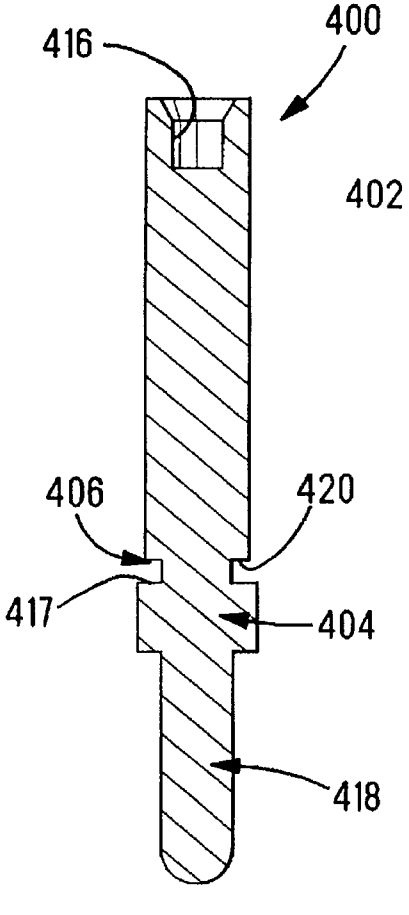
FIG. 7 is a cross-sectional view of the electrical contact shown in FIG. 6, as taken along line 7—7 in FIG. 6.
Figure 6:
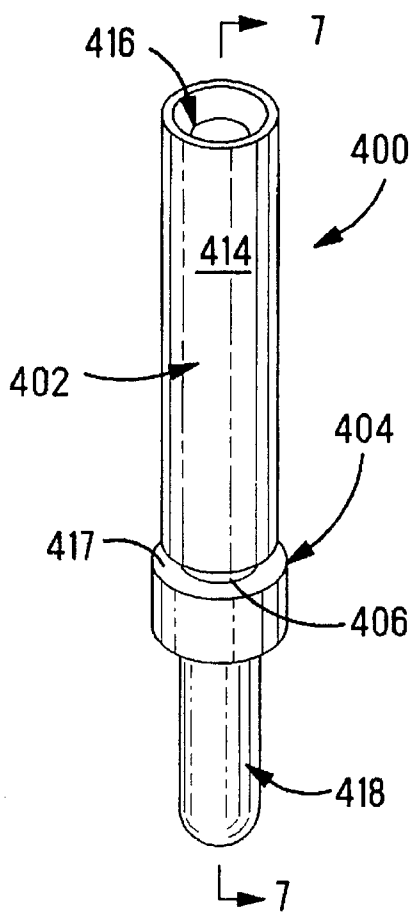
FIG. 6 shows one embodiment of an electrical contact adapted for use with the present invention.

Referring now to FIGS. 6, 7, 8, and 9, electrical contact 400 comprises an upper portion 402, a lower portion 404, and a groove 406 disposed therebetween. It will be understood of course that electrical contacts 400 may comprise any of the mating elements that are known in the art for either mechanically and/or electrically interconnecting connector assemblies together, or to printed circuit boards, or both. In one preferred embodiment of the present invention, electrical contact 400 comprises a substantially cylindrically-shaped upper portion 402 having an outer surface 414 and a female mating element 416. Lower portion 404 comprises a male mating element 418. Groove 406 is disposed between upper portion 402 and lower portion 404 so as to form shoulder 420 therebetween. Of course, it will be understood that electrical contact 400 may comprise either male or female mating elements disposed within upper portion 402 and lower portion 404. FIGS. 8 and 9, for example, show an electrical contact 401 comprising upper and lower male mating elements. In this embodiment, lower portion 404 also acts to stabilize electrical contact 401 within cavity 106.

An electrical connector assembly may be formed according to the present invention as follows. Retention clips 200 are first assembled within insulating housing 100, one per cavity. More particularly, each retention clip 200 is positioned so that cantilevered spring members 204 and 206 are placed in opposing relation to upper surface 102 of insulating housing 100. In this position, free ends 230 and 236 are disposed above cavities 106 so that first pair of spring members 204 are positioned above slots 120 and second pair of spring members 206 are positioned above side walls 114 and 116.

Once in this position (FIG. 1), retention clip 200 is moved toward insulating housing 100 so as to be inserted into a cavity 106. As this occurs, second pair of spring members 206 enter cavities 106 first, adjacent to side walls 114 and 116, followed by first pair of spring members 204 sliding into slots 120 of front wall 110 and rear wall 120. Retention clip 200 is slid into cavity 106 until spring members 204 engage recesses 126. More particularly, latches 232 of spring members 204 engage the inner wall of slot 120 thereby causing spring members 204 to be biased inwardly. As latches 232 engage recesses 126, spring members 204 spring outwardly so as to place latches 232 in engagement with shoulders 128. Once spring members 204 have sprung outwardly and engaged shoulder 128, corners 226 of retention clip 200 engage ledges 130, thus prohibiting further downward movement of retention clip 200 within cavity 106.

With retention clips 200 assembled within insulating housing 100, electrical contacts 400 can be inserted into cavities 106 to form an electrical connector assembly.

More particularly, and now referring to FIGS. 1 and 10–12, an insertion tool 500 is first inserted into cavities 106 from upper surface 102 of insulating housing 100 (FIGS. 10 and 11) o Insertion tool 500 comprises a tubular shaft 501 having a distal tip 502 that is sized and shaped to pass through cavity 106, and to easily enter annular portion 202 of retention clip 200. Tip 502 includes a centrally disposed recess that defines a pair of segment-shaped longitudinally extending beams 504. Each beam 504 includes a flat end 506 that is adapted to engage latch 240 of spring members 206, as will hereinafter be disclosed in detail.

Figure 11:
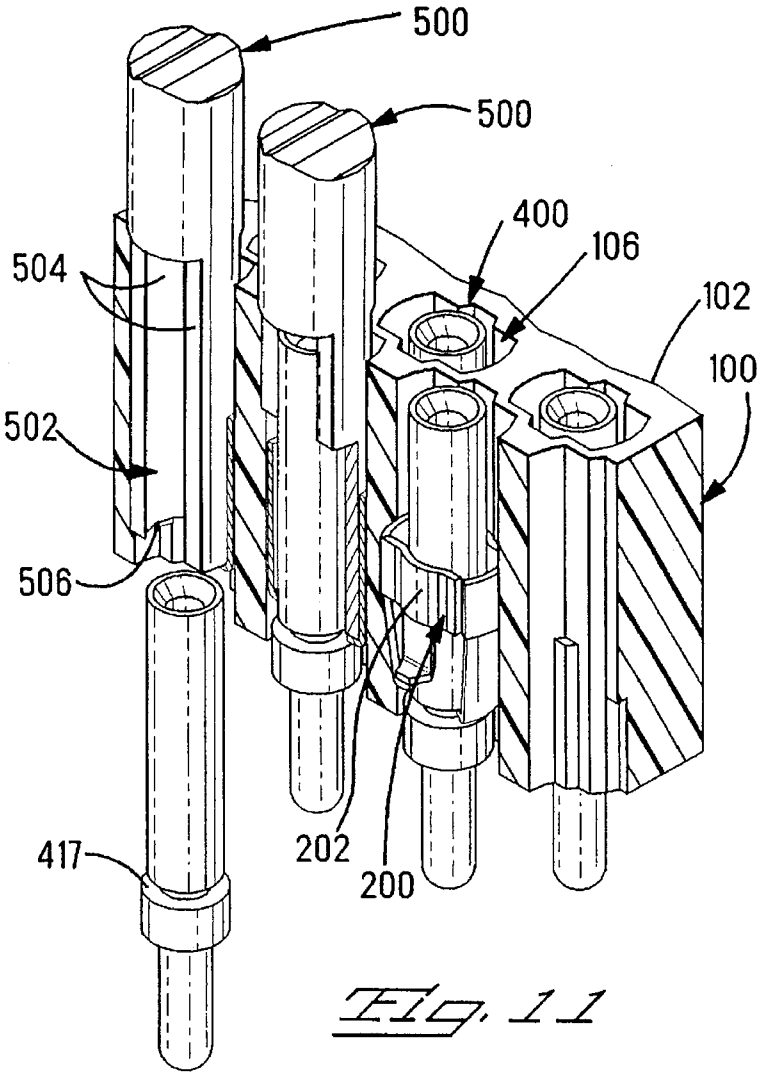
FIG. 11 is a broken-away cross-sectional view of the partially assembled insulating housing shown in FIG. 10.
Figure 10:
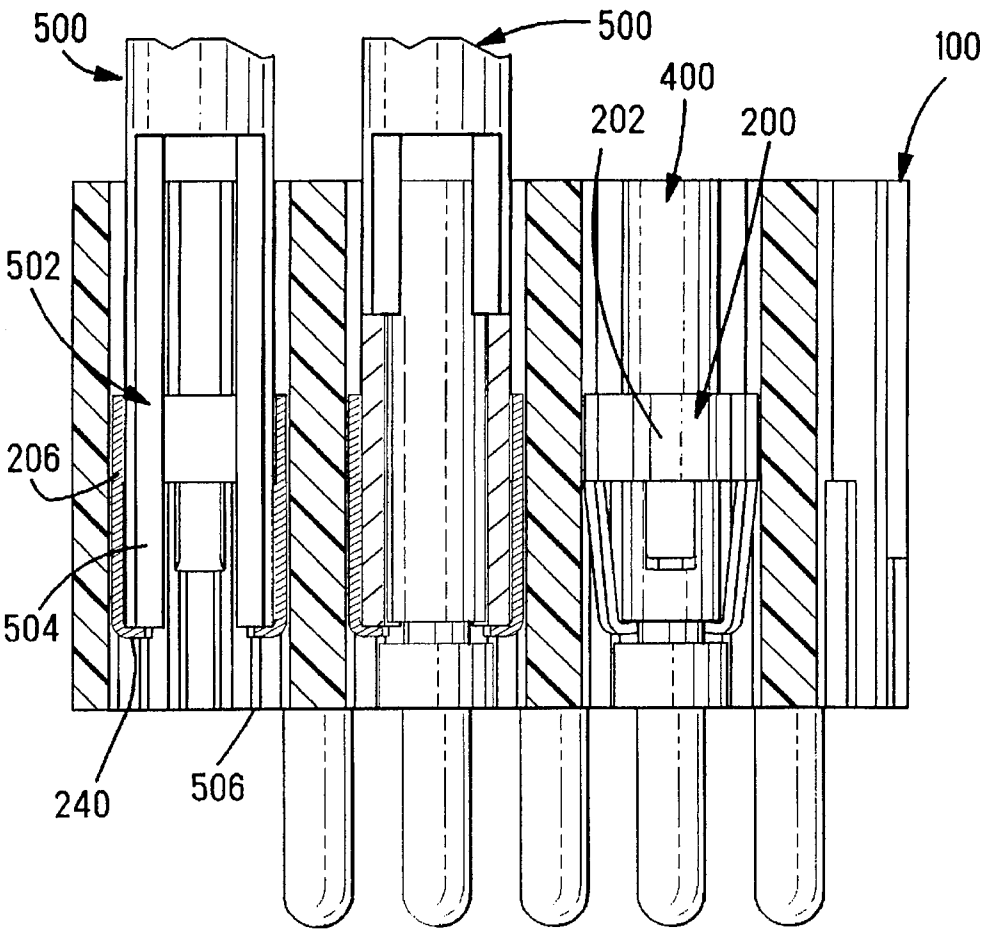
FIG. 10 is a front elevational view of a partially assembled insulating housing showing, sequentially from left to right, the relative positions of the electrical contacts, the retention clips, and an installation tool during assembly of the electrical connector of the present invention.

Insertion tool 500 is first inserted into a cavity 106 prior to the insertion of electrical contact 400. More particularly, tip 502 is oriented so as to be positioned opposite cavity 106. Insertion tool 500 is then moved toward insulating housing 100 so that beams 504 enter cavity 106 adjacent to side walls 114 and 116. Once within cavity 106, tip 502 moves along the interior of cavity 106 and enters annular portion 202 of retention clip 200 (FIG. 10). As flat ends 506 of beams 504 engage, and slide along, the inner surfaces of inwardly projecting spring members 206, spring members 206 are biased outwardly. As a result, opposing latches 240 are spread apart by a distance sufficient to allow upper portion 402 of electrical contact 400 to enter between latches 240. Insertion tool 500 continues to slide within cavity 106 and annular portion 202 until tips 506 engage latches 240 (FIG. 10 and 11).

Once in this position, an electrical contact 400 is positioned below lower surface 104 of insulating housing 100, with upper portion 402 placed in opposing relation to cavity 106. Electrical contact 400 is then moved toward insulating housing 100 so that upper portion 402 moves into cavity 106. Electrical contact 400 is then slid within cavity 106, with upper portion 402 sliding between latches 240 and the inner surfaces of beams 504 of insertion tool 500. Upwardly projecting latches 240 provide lead-in to facilitate the capture of upper portion 402 of electrical contacts 400 within retention clip 200. Electrical contact 400 ceases movement when latches 240 engage surface 417 (FIGS. 7, 9, 10 and 11) adjacent to groove 406. Once in this position, insertion tool 500 is withdrawn from retention clip 200 and cavity 106. As this occurs, spring members 206 spring back inwardly, toward their at rest position, and by doing so move retention latches 240 into engagement with shoulder 420 of electrical contact 400. It should also be noted that upper portion 402 is positioned within annular portion 202 of retention clip 200 so that the inner surfaces of bulges 220 are disposed in close, but nonengaging, proximity thereto thus acting to stabilize electrical contact 400 therein. In this way, electrical contacts 400 are captured within cavities 106 and retained therein by spring members 206 of retention clip 200.

To complete assembly, spacer-cap 300 is assembled to insulating housing 100 (FIG. 1–2, and 5). More particularly, spacer-cap 300 is moved into position above upper surface 102 of insulating housing 100, and oriented so that sockets 304 are disposed in opposing-relation to cavities 106. From this position, spacer-cap 300 is moved toward upper surface 102 so that each pair of sockets 304 enters a respective opposing cavity 106. In particular, each segment-shaped beam 304 slides into its corresponding cavity 106 so as to be disposed in surrounding-relation to upper portion 402 of electrical contact 400. Spacer-cap 300 is moved toward insulating housing 100 until housing mating surface 312 engages upper surface 102 of insulating housing 100. It will be understood that a latching mechanism and/or hold down device (not shown) may be disposed on either insulating housing 100 or spacer-cap 300 so as to maintain spacer-cap 300 in position on upper surface 102 of insulating housing 100. It will also be understood that sockets 304 are disposed about upper portion 402 of electrical contact 400 so as to stabilize electrical contact 400 within cavity 106 thus facilitating mating with a corresponding electrical contact.

Electrical contacts 400 may be removed from electrical connector assembly by reversing the foregoing process. More particularly, and again referring to FIGS. 10 and 11, spacer-cap 300 is first removed from insulating housing 100, thus fully exposing cavities 106. Insertion tool 500 is then reinserted into cavities 106 so as to receive upper portion 402 of electrical contact 400 between beams 504. Again, as is disclosed hereinabove, beams 504 engage spring members 206 and bias spring members 206 outwardly thus releasing latches 240 from engagement with shoulders 420 of electrical contact 400. Electrical contact 400 is then withdrawn from cavity 106 and removed and/or replaced.

Figure 14:
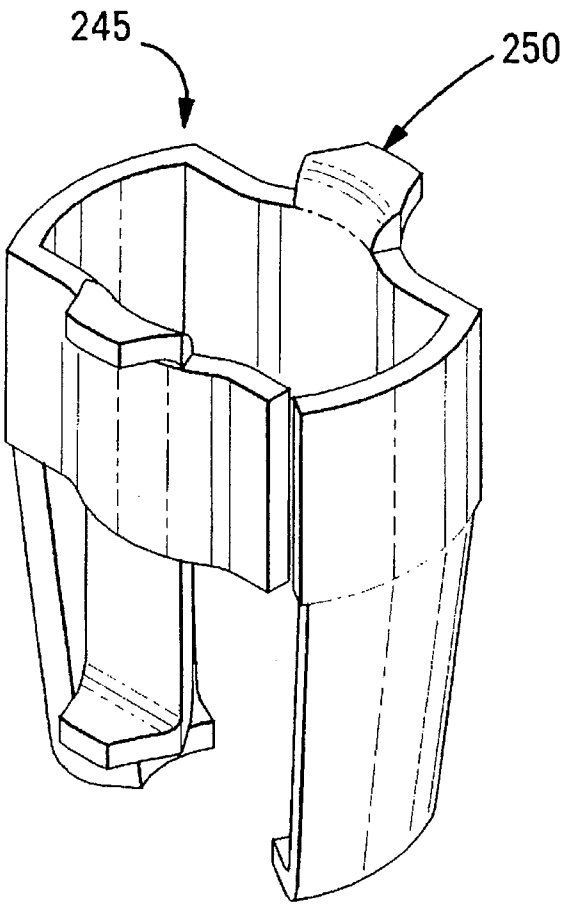
FIG. 14 is a perspective view of another alternative embodiment of the retention clip.
Figure 13:
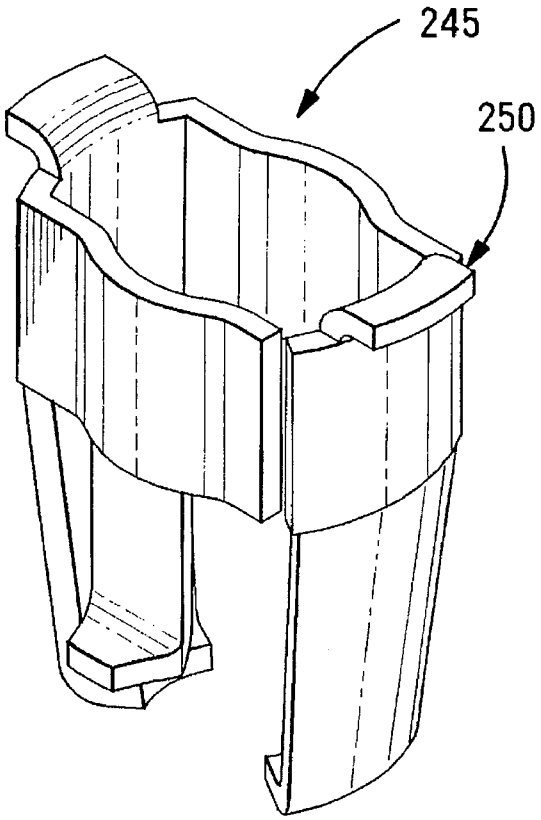
FIG. 13 is a perspective view of an alternative embodiment of the retention clip.
Figure 12:
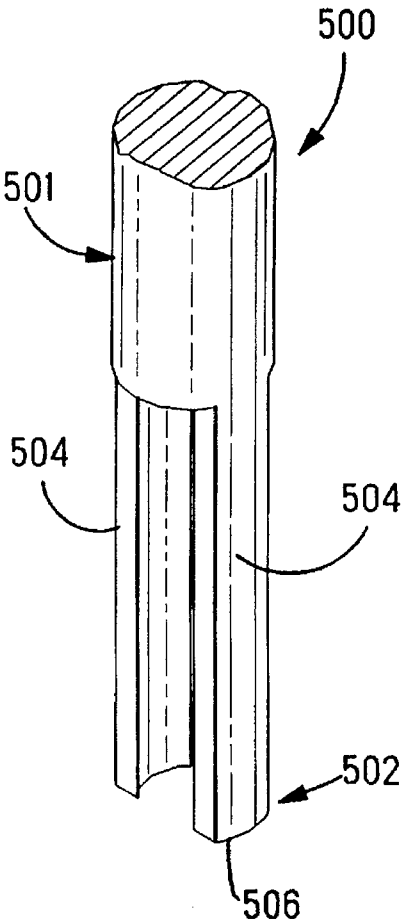
FIG. 12 is a perspective view of the tip of the installation tool shown in FIGS. 10 and 11.
Figure 15:
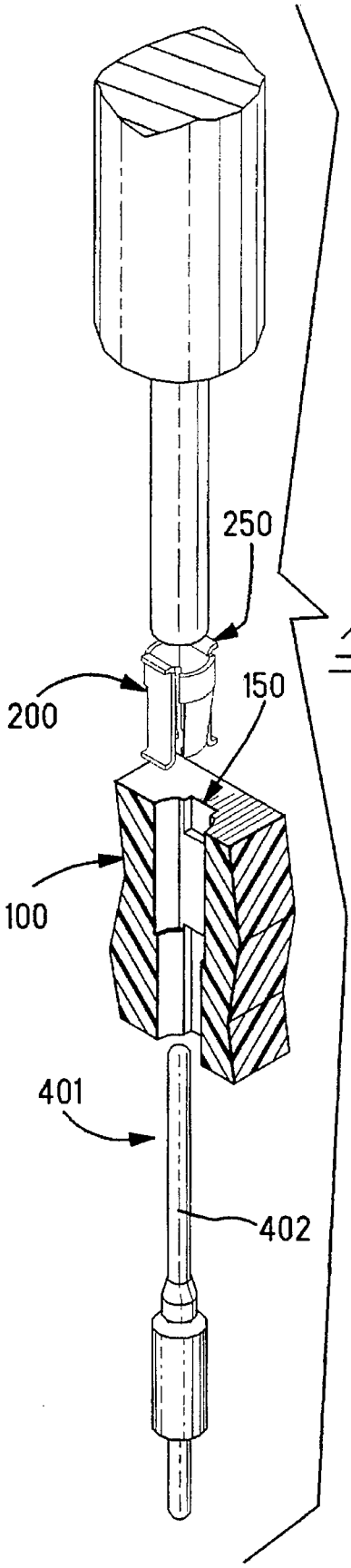
FIG. 15 is a broken-away cross-sectional view of the alternative embodiment of the electrical contact shown in FIGS. 8 and 9, and the alternative retention clip shown in FIG. 14, being assembled to an insulating housing with an alternate assembly tool, with the constituent elements shown in an exploded perspective view.
Figure 16:
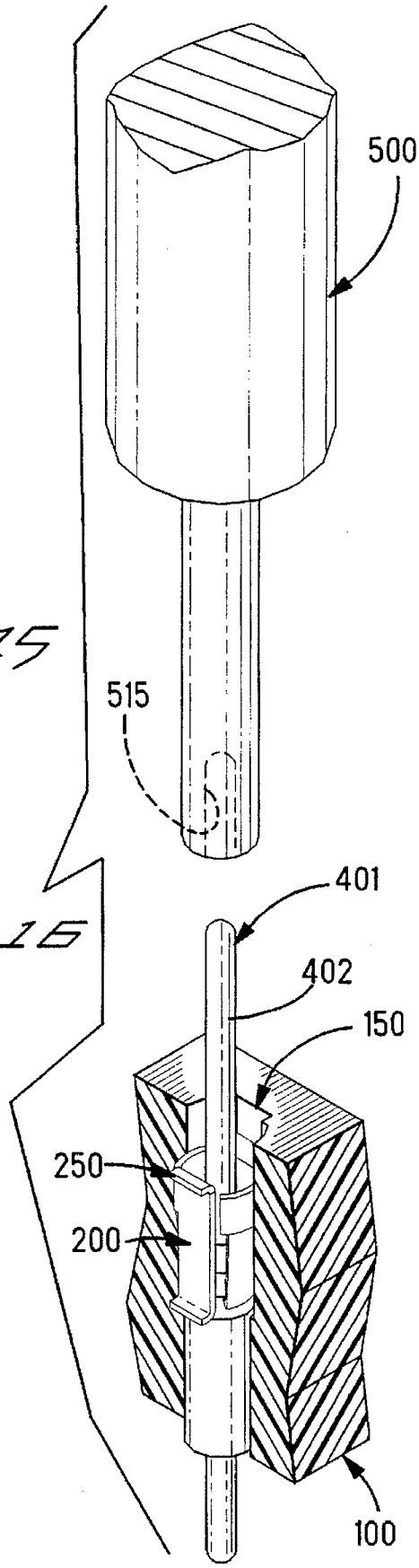
FIG. 16 is a broken-away cross-sectional view of the alternative embodiment shown in FIG. 15, after the electrical contact has been fully captured within the retention clip.

Various modifications, alterations, and variations of the herein disclosed components may be substituted without departing from the scope and/or spirit of the present invention. For example, and now referring to FIGS. 13 and 14, a retention clip 245 may include tabs 250 disposed on each upper edge of side walls 214 and 216, or front wall 210 and rear wall 212. Tabs 250 are adapted to engage a pair of corresponding slots 150 disposed within an upper portion of cavities 106 of insulating housing 100 so as to maintain retention clip 245 at a predetermined position within cavity 106, as well as maintain retention clip 245 in a predetermined orientation (FIGS. 15 and 16). Likewise, and now referring to FIGS. 15 and 16, when an electrical contact 401 comprising an upper portion 402 having a male mating element is to be inserted into insulating housing 100, insertion tool 500 will comprise a shaft having an internal bore 515 extending longitudinally from its tip. Bore 515 is sized and shaped to accept the male member.

It is also to be understood that the present invention is by no means limited to the particular construction herein disclosed and/or shown in the drawings, but also comprises any modifications or equivalents within the scope of the claims.

What is claimed is:

1. An electrical connector assembly adapted to releasably retain a plurality of electrical contacts, said electrical connector assembly comprising, in combination:

an insulating housing having an upper surface, a lower surface, and a plurality of electrical contact receiving cavities extending therebetween and arranged therein in a predetermined pattern, said cavities being defined within said insulating housing by a plurality of surrounding internal structures comprising (i) at least two opposing longitudinal slots having opposing recesses disposed within said slots in spaced-away relation to said upper surface and said lower surface of said insulating housing, and (ii) at least one ledge protruding into said cavity above said recesses;

a retention clip disposed within each of said cavities, said retention clip comprising a plurality of cantilevered spring members projecting downwardly from an annular portion of said clip wherein a first pair of said spring members are disposed in opposing outwardly protruding relation to one another on a first pair of opposing walls of said annular portion, each of said first pair of spring members further including an outwardly protruding latch disposed at a free end thereof and adapted to releasable engage a portion of said recess when said retention clip is positioned within said insulating housing and further wherein a second pair of said spring members is disposed in opposing inwardly protruding relation to one another on a second pair of opposing walls of said annular portion, each of said second pair of spring members including an inwardly protruding latch disposed at a free end thereof and adapted to releasably engage a portion of said electrical contact when said retention clip is positioned within said insulating housing and said electrical contact is disposed within said cavity;

said electric contacts each comprise an upper mating portion having an outer surface, a lower mating portion and a circumferential groove disposed therebetween, said groove being adapted to releasably engage said latch of said second pair of spring members when said electrical contact is positioned within said cavity; and a spacer-cap releasably attached to said upper surface of said insulating housing, said spacer-cap comprising a plate having an upper surface, a lower surface, and a plurality of bores extending therebetween, said plurality of bores being disposed within said plate in a pattern corresponding to said predetermined pattern of cavities in said insulating housing, said spacer-cap further including a plurality of cantilevered beams projecting downwardly from said lower surface in surrounding relation to said bores and extending into said cavities, whereby said beams engage said outer surface of said upper mating portion of said electrical contacts so as to provide for stable positioning thereof within said cavity.

2. An electrical connector assembly according to claim 1 wherein said circumferential groove defines a shoulder that is sized and shaped to engage said outwardly protruding latch of said first pair of spring members when said electrical contact is fully positioned within said retention clip.

3. An electrical connector assembly according to claim 1 wherein said upper surface of said spacer-cap includes a chamfer edge disposed about each of said bores so as to provide lead-in for guiding a mating contact into said bore during interconnection with a corresponding mating electrical connector assembly.

4. An electrical connector assembly according to claim 1 wherein said insulating housing further includes a pair of opposing slots disposed within an upper portion of said cavities and wherein said retention clips further include a pair of tabs disposed on at least two opposing upper edges of said annular portion whereby during insertion of said retention clip into said cavity, said tabs engage said slots so as to maintain said retention clip at a predetermined position within said cavity.

5. An electrical connector assembly according to claim 1 wherein said retention clip comprises a spring tempered metal alloy.

6. An electrical connector assembly according to claim 1 wherein said retention clip comprises a resilient polymer material.

7. An electrical connector assembly according to claim 5 wherein said retention clip comprises a half-hard phosphor bronze.

8. An electrical connector assembly according to claim 1 wherein said insulating housing comprises a liquid crystal polyester.

9. An electrical connector assembly according to claim 1 wherein said insulating housing comprises at least two ledges disposed within said cavities.

10. An electrical connector assembly according to claim 1 wherein said insulating housing comprises four ledges disposed within said cavities.

11. A contact retention and removal system comprising, in combination:

(A) an electrical connector assembly adapted to releasably retain a plurality of electrical contacts, said electrical connector assembly comprising, in combination:

an insulating housing having an upper surface, a lower surface, and a plurality of electrical contact receiving cavities extending therebetween and arranged therein in a predetermined pattern, said cavities being defined within said insulating housing by a plurality of surrounding internal structures comprising (i) at least two opposing longitudinal slots having opposing recesses disposed within said slots in spaced-away relation to said upper surface and said lower surface of said insulating housing, and (ii) at least one ledge protruding into said cavity above said recesses;

a retention clip disposed within each of said cavities, said retention clip comprising a plurality of cantilevered spring members projecting downwardly from an annular portion of said clip wherein a first pair of said spring members are disposed in opposing outwardly protruding relation to one another on a first pair of opposing walls of said annular portion, each of said first pair of spring members further including an outwardly protruding latch disposed at a free end thereof and adapted to releasable engage a portion of said recess when said retention clip is positioned within said insulating housing and further wherein a second pair of said spring members is disposed in opposing inwardly protruding relation to one another on a second pair of opposing walls of said annular portion, each of said second pair of spring members including an inwardly protruding latch disposed at a free end thereof and adapted to releasably engage a portion of said electrical contact when said retention clip is positioned within said insulating housing and said electrical contact is disposed within said cavity;

said electric contacts each comprise an upper mating portion having an outer surface, a lower mating portion and a circumferential groove disposed therebetween, said groove being adapted to releasably engage said latch of said second pair of spring members when said electrical contact is positioned within said cavity; and a spacer-cap releasably attached to said upper surface of said insulating housing, said spacer-cap comprising a plate having an upper surface, a lower surface, and a plurality of bores extending therebetween, said plurality of bores being disposed within said plate in a pattern corresponding to said predetermined pattern of cavities in said insulating housing, said spacer-cap further including a plurality of cantilevered beams projecting downwardly from said lower surface in surrounding relation to said bores and extending into said cavities, whereby said beams engage said outer surface of said upper mating portion of said electrical contacts so as to provide for stable positioning thereof within said cavity; and (B) an insertion/extraction tool comprising a tubular shaft having a distal tip adapted to fit within said cavity of said insulating housing and said annular portion of said retention clip, said tip comprising a centrally disposed recess defining a pair of segment-shaped longitudinally extending beams each terminating in a flat end surface that is adapted to engage said latch on said second pair of spring members when said tool is inserted into said retention clip.

12. A method for inserting and retaining a plurality of electrical contacts within an electrical connector assembly, said method comprising the steps of:

(a) providing an electrical connector assembly adapted to releasably retain a plurality of electrical contacts, said electrical connector assembly comprising, in combination:

an insulating housing having an upper surface, a lower surface, and a plurality of electrical contact receiving cavities extending therebetween and arranged therein in a predetermined pattern, said cavities being defined within said insulating housing by a plurality of surrounding internal structures comprising (i) at least two opposing longitudinal slots having opposing recesses disposed within said slots in spaced-away relation to said upper surface and said lower surface of said insulating housing, and (ii) at least one ledge protruding into said cavity above said recesses;

a retention clip disposed within each of said cavities, said retention clip comprising a plurality of cantilevered spring members projecting downwardly from an annular portion of said clip wherein a first pair of said spring members are disposed in opposing outwardly protruding relation to one another on a first pair of opposing walls of said annular portion, each of said first pair of spring members further including an outwardly protruding latch disposed at a free end thereof and adapted to releasable engage a portion of said recess when said retention clip is positioned within said insulating housing and further wherein a second pair of said spring members is disposed in opposing inwardly protruding relation to one another on a second pair of opposing walls of said annular portion, each of said second pair of spring members including an inwardly protruding latch disposed at a free end thereof and adapted to releasably engage a portion of said electrical contact when said retention clip is positioned within said insulating housing and said electrical contact is disposed within said cavity;

said electric contacts each comprise an upper mating portion having an outer surface, a lower mating portion and a circumferential groove disposed therebetween, said groove being adapted to releasably engage said latch of said second pair of spring members when said electrical contact is positioned within said cavity;

(b) providing an insertion/extraction tool comprising a tubular shaft having a distal tip adapted to fit within said cavity of said insulating housing and said annular portion of said retention clip, said tip comprising a centrally disposed recess defining a pair of segment-shaped longitudinally extending beams each terminating in a flat end surface that is adapted to engage said latch on said second pair of spring members when said tool is inserted into said retention clip;

(c) inserting said retention clip into said cavity until said latches disposed on said first pair of spring members engage a shoulder defined by the intersection of said slot and said recess;

(d) inserting said distal tip of said tool into said cavities and thereby into said annular portion of said retention clip until said second pair of spring members are biased outwardly and said tip of said tool engages said latches disposed on said second pair of spring members;

(e) inserting said electrical contacts, upper portion first, into said insulating housing from said lower surface thereof until said circumferential groove is positioned in opposing relation to said latches disposed on said second pair of spring members; and (f) withdrawing said tool.

13. A method according to claim 12 further including the step of:

(g) releaseably attaching a spacer-cap to said upper surface of said insulating housing, said spacer-cap comprising a plate having an upper surface, a lower surface, and a plurality of bores extending therebetween, said plurality of bores being disposed within said plate in a pattern corresponding to said predetermined pattern of cavities in said insulating housing, said spacer-cap further including a plurality of cantilevered beams projecting downwardly from said lower surface in surrounding relation to said bores and extending into said cavities, whereby said beams engage said outer surface of said upper mating portion of said electrical contacts so as to provide for stable positioning thereof within said cavity.

* * * * *